US006280000B1

(12) United States Patent
Zupanick

(10) Patent No.: US 6,280,000 B1
(45) Date of Patent: Aug. 28, 2001

(54) METHOD FOR PRODUCTION OF GAS FROM A COAL SEAM USING INTERSECTING WELL BORES

(76) Inventor: Joseph A. Zupanick, HCR 72, Box 67, Pineville, WV (US) 24874

( * ) Notice: Subject to any disclaimer, the term of this patent is extended or adjusted under 35 U.S.C. 154(b) by 0 days.

(21) Appl. No.: 09/197,687

(22) Filed: Nov. 20, 1998

(51) Int. Cl.[7] ..... E21F 7/00

(52) U.S. Cl. ..... 299/12; 166/245; 166/263; 166/50; 166/52

(58) Field of Search ..... 166/245, 263, 166/50, 52; 299/12, 2

(56) References Cited

U.S. PATENT DOCUMENTS

| | | | |
|---|---|---|---|
| 54,144 | 4/1866 | Hamar . | |
| 274,740 | 9/1883 | Douglass . | |
| 526,708 | 10/1894 | Horton . | |
| 639,036 | 12/1899 | Heald . | |
| 1,189,560 | 7/1916 | Gondos . | |
| 1,285,347 | 11/1918 | Otto . | |
| 1,467,480 | 9/1923 | Hogue . | |
| 1,485,615 | 3/1924 | Jonas . | |
| 1,674,392 | 6/1928 | Flansburg . | |
| 1,777,961 | 10/1930 | Capeliuschnicoff . | |
| 2,018,285 | 10/1935 | Schweitzer et al. | 100/21 |
| 2,069,482 | 2/1937 | Seay | 255/76 |
| 2,150,228 | 3/1939 | Lamb | 100/10 |
| 2,169,718 | 8/1939 | Böll et al. | 255/24 |
| 2,335,085 | 11/1943 | Roberts | 251/197 |
| 2,450,223 | 9/1948 | Barbour | 265/76 |
| 2,490,350 | 12/1949 | Grable | 166/4 |
| 2,679,903 | 6/1954 | McGowen Jr., et al. | 100/1 |
| 2,726,063 | 12/1955 | Ragland et al. | 255/1.8 |
| 2,780,018 | 2/1957 | Lytie | 251/25 |
| 2,847,189 | 8/1958 | Shook | 255/76 |
| 2,911,008 | 11/1959 | Bois | 137/637.31 |
| 2,980,142 | 4/1961 | Turak | 137/673.3 |
| 3,347,595 | 10/1967 | Dahms, et al. | 299/4 |
| 3,443,648 | 5/1969 | Dugay | 197/624.4 |
| 3,503,377 | 3/1970 | Beatenbough et al. | 123/117 |
| 3,528,516 | 9/1970 | Brown | 175/267 |

(List continued on next page.)

FOREIGN PATENT DOCUMENTS

| | | |
|---|---|---|
| 0 819 834 A1 | 1/1998 | (EP) . |
| 0 952 300 A1 | 1/1998 | (EP) . |
| 197 25 996 A1 | 1/1998 | (DE) . |
| 0 875 661 A1 | 11/1998 | (EP) . |
| WO 94/21889 | 9/1994 | (WO) . |

OTHER PUBLICATIONS

Dave Hassan, Mike Chernichen, Earl Jensen, and Morley Frank; "Multi–lateral technique lowers drilling costs, provides environmental benefits", Drilling Technology, pp. 41–47, Oct. 1999.

Mining Engineering Handbook; Hartman, H. Senior Ed.; 1992 pp. 1946–1950.*

PCT Search Report PCT/US/99/27494.

*Primary Examiner*—David Bagnell
*Assistant Examiner*—John Kreck
(74) *Attorney, Agent, or Firm*—Baker Botts L.L.P.

(57) ABSTRACT

A method for removing water and producing methane from a subterranean coal seam. The method includes drilling a first substantially vertical well bore to the depth of the target coal seam, enlarging the bore of the vertical well at the depth of a target coal seam to provide an enlarged cavity, drilling an offset well intersecting the cavity substantially horizontally and then drilling through the cavity in order to drill substantially horizontal drainage well bores in the coal seam. The method may be used as a pre-mining step in conjunction with subterranean mining of the coal seam in order to remove methane and other dangerous gases and excess water from the coal seam in advance of mining operations.

14 Claims, 3 Drawing Sheets

U.S. PATENT DOCUMENTS

| | | | | |
|---|---|---|---|---|
| 3,530,675 | | 9/1970 | Turzillp | 51/35 |
| 3,681,011 | | 8/1972 | Kammerer, Jr., et al. | 175/267 |
| 3,692,041 | | 9/1972 | Bondi | 137/238 |
| 3,757,877 | | 9/1973 | Leathers | 175/269 |
| 3,800,830 | | 4/1974 | Etter | 137/625.41 |
| 3,809,519 | | 5/1974 | Garner | 425/245 |
| 3,828,867 | | 8/1974 | Elwood | 175/45 |
| 3,874,413 | | 4/1975 | Valdez | 137/625.41 |
| 3,902,322 | | 9/1975 | Wantanbe | 61/35 |
| 3,934,649 | * | 1/1976 | Pasini, III et al. | 299/12 |
| 3,957,082 | | 5/1976 | Fuson et al. | 137/625.41 |
| 3,961,824 | | 6/1976 | Van Eek, et al. | 299/17 |
| 4,037,658 | | 7/1977 | Anderson | 166/272 |
| 4,073,351 | | 2/1978 | Baum | 175/14 |
| 4,089,374 | | 5/1978 | Terry | 166/259 |
| 4,116,012 | | 9/1978 | Abe et al. | 405/238 |
| 4,156,437 | | 5/1979 | Chivens et al. | 137/554 |
| 4,160,510 | | 7/1979 | Melgs | 175/66 |
| 4,189,184 | | 2/1980 | Green | 200/8 |
| 4,220,203 | | 9/1980 | Steeman | 166/271 |
| 4,221,433 | | 9/1980 | Jacoby | 299/4 |
| 4,257,650 | * | 3/1981 | Allen | 299/2 |
| 4,278,137 | | 7/1981 | Van Eed, deceased | 175/287 |
| 4,295,785 | | 10/1981 | Vitello et al. | 141/105 |
| 4,299,295 | | 11/1981 | Gossard | 175/45 |
| 4,312,377 | | 1/1982 | Knecht | 137/325.19 |
| 4,317,492 | | 3/1982 | Summers et al. | 175/79 |
| 4,366,988 | | 1/1983 | Bodine | 299/14 |
| 4,372,398 | | 2/1983 | Kuckes | 175/45 |
| 4,390,067 | | 6/1983 | Willman | 166/245 |
| 4,396,076 | | 8/1983 | Inoue | 175/265 |
| 4,397,360 | | 8/1983 | Schmidt | 175/61 |
| 4,401,171 | | 8/1983 | Fuchs | 176/207 |
| 4,407,376 | | 10/1983 | Inoue | 175/267 |
| 4,444,896 | | 4/1984 | Reale, et al. | 166/278 |
| 4,494,010 | | 1/1985 | McKee | 175/67 |
| 4,512,422 | | 4/1985 | Knisley | 175/99 |
| 4,527,639 | | 7/1985 | Kickinson, III et al. | 175/61 |
| 4,532,986 | | 8/1985 | Mims, et al. | 166/50 |
| 4,544,037 | | 10/1985 | Terry | 166/369 |
| 4,558,744 | | 12/1985 | Gibb | 166/335 |
| 4,566,252 | | 1/1986 | Campbell et al. | 175/269 |
| 4,600,061 | * | 7/1986 | Richards | 299/12 |
| 4,605,076 | * | 8/1986 | Goodhart | 166/50 |
| 4,611,855 | * | 9/1986 | Richards | 299/2 |
| 4,618,009 | | 10/1986 | Carter et al. | 175/267 |
| 4,638,949 | | 1/1987 | Mancel | 239/307 |
| 4,674,579 | | 6/1987 | Geller et al. | 176/15 |
| 4,702,314 | | 10/1987 | Huang, et al. | 166/245 |
| 4,715,400 | | 12/1987 | Boxell et al. | 166/100 |
| 4,763,734 | | 8/1988 | Dickinsin et al. | 175/61 |
| 4,830,105 | | 5/1989 | Petermann | 166/241 |
| 4,842,061 | | 6/1989 | Parant | 175/23 |
| 4,852,666 | | 8/1989 | Brunet et al. | 175/61 |
| 4,978,172 | | 12/1990 | Schwoebel et al. | 299/12 |
| 5,016,710 | | 5/1991 | Renard, et al. | 166/245 |
| 5,035,605 | | 7/1991 | Dineman et al. | 425/564 |
| 5,036,921 | | 8/1991 | Pittard et al. | 166/298 |
| 5,074,360 | | 12/1991 | Guinn | 166/281 |
| 5,074,365 | | 12/1991 | Kuckes | 175/40 |
| 5,074,366 | | 12/1991 | Karlsson et al. | 175/70 |
| 5,111,893 | | 5/1992 | Kvello-Aune | 175/258 |
| 5,135,058 | | 8/1992 | Millgard et al. | 175/71 |
| 5,148,875 | | 9/1992 | Karlsson et al. | 175/62 |
| 5,168,042 | | 12/1992 | Wydrineski | 175/50 |
| 5,174,374 | | 12/1992 | Halley | 166/55.8 |
| 5,197,553 | | 3/1993 | Letumo | 175/57 |
| 5,197,783 | | 3/1993 | Thelmer et al. | 299/17 |
| 5,199,496 | | 4/1993 | Redus et al. | 166/366 |
| 5,201,617 | | 4/1993 | Hailey | 175/209 |
| 5,217,076 | * | 6/1993 | Masek | 166/303 |
| 5,240,350 | | 8/1993 | Yamaguchi et al. | 405/143 |
| 5,242,017 | | 9/1993 | Hailey | 166/55.8 |
| 5,246,273 | | 9/1993 | Rosar | 299/4 |
| 5,255,741 | | 10/1993 | Alexander | 166/278 |
| 5,271,472 | | 12/1993 | Letuno | 175/107 |
| 5,301,760 | | 4/1994 | Graham | 175/61 |
| 5,363,927 | | 11/1994 | Frank | 175/67 |
| 5,385,205 | | 1/1995 | Hailey | 166/55.8 |
| 5,402,851 | | 4/1995 | Baiton | 166/369 |
| 5,411,085 | | 5/1995 | Moore et al. | 166/242 |
| 5,411,104 | | 5/1995 | Stanley | 175/65 |
| 5,450,902 | | 9/1995 | Matthews | 166/268 |
| 5,454,410 | | 10/1995 | Vioedman | 166/277 |
| 5,462,116 | * | 10/1995 | Carroll | 166/249 |
| 5,469,155 | | 11/1995 | Archambeault et al. | 340/853.4 |
| 5,485,089 | | 1/1996 | Kuckes | 324/346 |
| 5,494,121 | | 2/1996 | Nackerud | 175/263 |
| 5,501,173 | | 3/1996 | Puri | 166/252.5 |
| 5,501,279 | | 3/1996 | Garg. et al. | 166/372 |
| 5,584,605 | | 12/1996 | Beard et al. | 405/128 |
| 5,615,739 | | 4/1997 | Dallas | 166/306 |
| 5,658,347 | | 8/1997 | Taylor | 347/85 |
| 5,669,444 | | 9/1997 | Riese, et al | 166/263 |
| 5,690,390 | | 11/1997 | Dithell | 299/4 |
| 5,706,871 | | 1/1998 | Andersson et al. | 141/59 |
| 5,720,356 | | 2/1998 | Cardes | 175/62 |
| 5,785,133 | | 7/1998 | Murray et al. | 175/61 |
| 5,832,958 | | 11/1998 | Cheng | 197/625.41 |
| 5,853,054 | | 12/1998 | McGarian et al. | 175/267 |
| 5,868,202 | | 2/1999 | Hsu | 166/256 |
| 5,868,210 | * | 2/1999 | Johnson et al. | 175/40 |
| 5,879,057 | | 3/1999 | Schwoebel, et al. | 299/17 |
| 5,917,325 | | 6/1999 | Smith | 324/326 |
| 5,934,390 | | 8/1999 | Uthe | 175/67 |
| 5,957,539 | | 9/1999 | Durup et al. | 299/4 |
| 6,024,171 | * | 2/2000 | Montgomery et al. | 166/308 |

* cited by examiner 10
24
26
18
14
36
38
16
30
32
28
40
12
20
35
34

METHOD FOR PRODUCTION OF GAS FROM A COAL SEAM USING INTERSECTING WELL BORES

BACKGROUND OF THE INVENTION

Subterranean deposits of coal, whether of "hard" coal such as anthracite or "soft" coal such as lignite or bituminous contain substantial quantities of methane gas entrained in the coal deposits. Limited production and use of methane gas from coal deposits has occurred for many years. However there are substantial obstacles which heretofore have frustrated more extensive development and use of methane gas deposits in coal seams. The foremost problem is the fact that coal seams, while they may extend over large areas of up to several thousand acres, typically are fairly shallow in depth, varying from a few inches to several meters. While they often are relatively near the surface (a thousand feet or less), vertical wells drilled into the coal deposits for obtaining methane gas can drain only a fairly small radius around the coal deposits. Further, the coal deposits are not amenable to pressure fracturing and other methods often used for increasing methane gas production from rock formations, so that, once the gas easily drained by a vertical well bore into the coal seam is produced, further production tends to be quite limited in volume. Additionally, coal seams often are associated with subterranean water, which must be drained from the coal seam in order to produce the methane.

Horizontal drilling patterns have been tried in order to extend the amount of coal seam exposed to a drill bore for gas extraction. But removal of the entrained water has presented difficulties in these operations. Horizontal drilling techniques require the use of a radiused well bore portion and a horizontal bore. The most efficient method for pumping water from a subterranean well, a sucker rod pump, does not work well in horizontal bores or around radiused bores.

A further problem which has been encountered in prior art techniques for producing gas from coal seams is the difficulty presented by under balanced drilling conditions resulting from the porousness of the coal seam. During the well drilling operations, whether vertical or horizontal, drilling fluid used to remove cuttings to the surface presents a hydrostatic pressure on the formation which, if it exceeds the hydrostatic pressure in the formation, can result in a loss of drilling fluid into the formation. This results in entrainment of drilling fines in the formation, which tends to plug up the small cracks and fractures which are needed to produce the gas.

SUMMARY OF THE INVENTION

It is accordingly, the primary object of the present invention to provide a method and apparatus for removing water and producing gas from subterranean coal seams which overcome the disadvantages found in the prior art.

A further object is to provide such a method and apparatus in which two wells are drilled in tandem, a vertical well having a bottom cavity terminating at or below the target coal seam and an offset well having a substantially horizontal portion which intersects the bottom cavity in the vertical well. The vertical well provides means for exact identification, via logging, of the target coal seam, and for efficient sucker rod pumping of water from the formation, while the offset well provides means for drilling a substantially horizontal drainage pattern in the target coal seam which intersects the vertical well bottom cavity, for optimal drainage of water and gas from the coal seam.

A still further object is to provide such a method and apparatus in which the prior art problem of overbalanced pressure conditions is overcome by injection of aerating gas into the drilling fluid to reduce bottom hole hydrostatic pressure.

A further object is to provide such a method and apparatus which may be used advantageously in conjunction with subterranean coal mining operations, in order to remove dangerous gases and water from a coal seam in advance of mining the subterranean coal seam for extraction of the coal.

DESCRIPTION OF THE DRAWINGS

The foregoing objects and advantages of the invention will be apparent from the following description of the preferred embodiment of the invention, in conjunction with the drawings, in which.

DESCRIPTION OF THE PREFERRED EMBODIMENT

Figure 1:
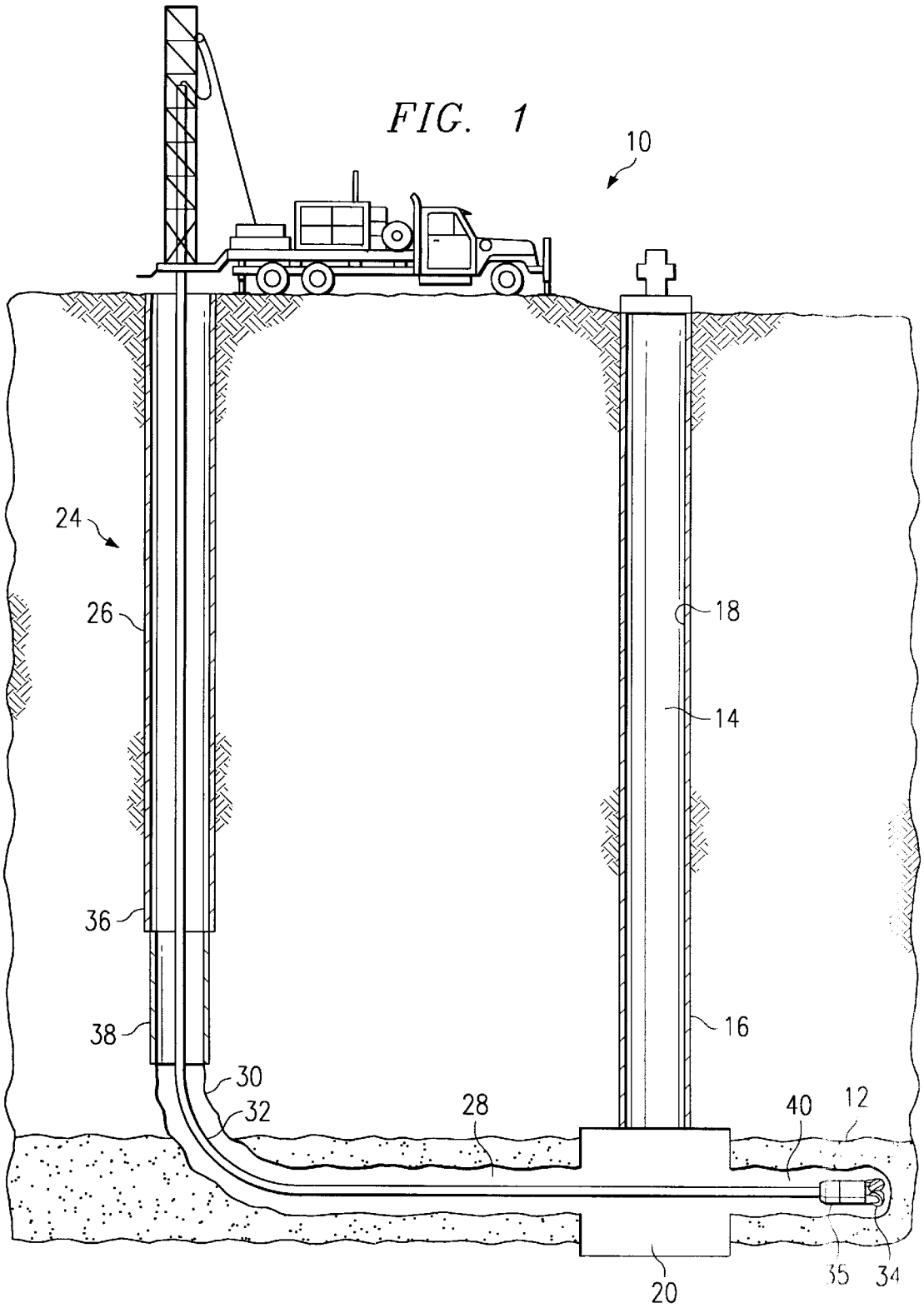
FIG. 1 is a somewhat diagrammatic representation, not to scale, of a vertical well and an offset well being used in conjunction to provide a drainage well bore for a target coal seam.
Figure 2:
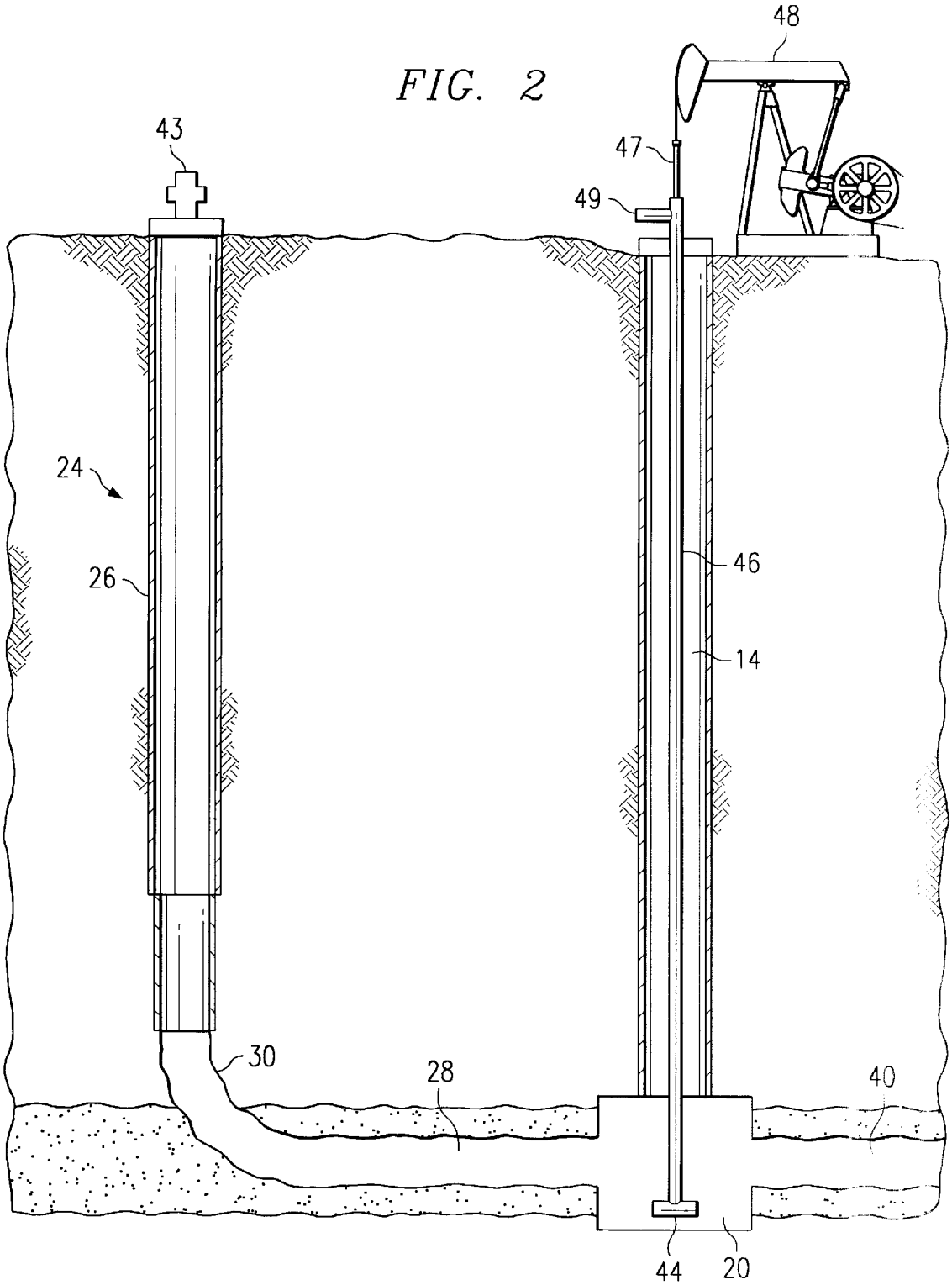
FIG. 2 is a diagrammatic illustration similar to FIG. 1, not to scale, showing the wells being used to produce gas and to remove water from the coal seam.
Figure 3:
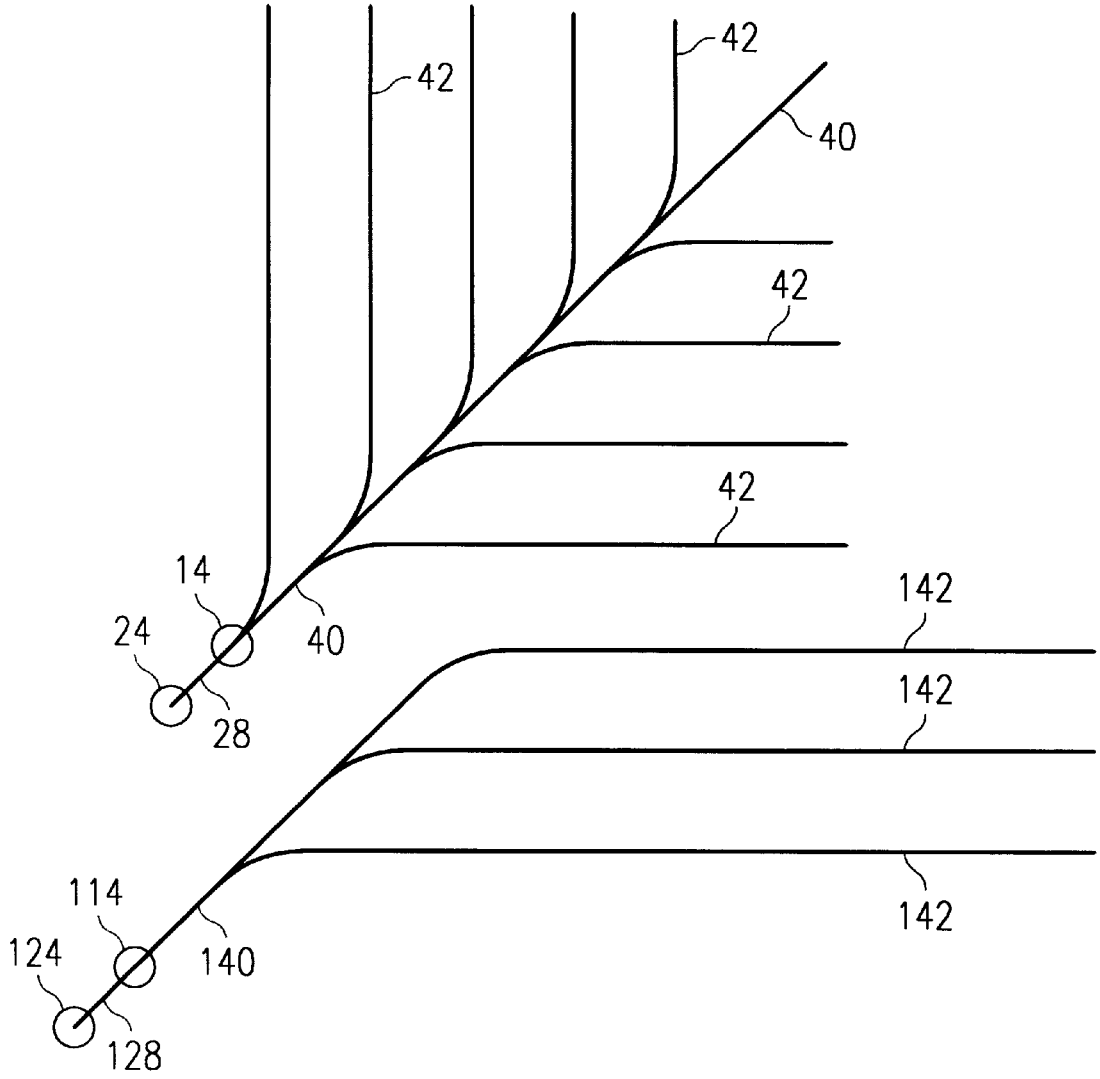
FIG. 3 is a diagrammatic illustration, not to scale, of drainage well bore patterns drilled in the coal seam.

Referring now to FIG. 1, there is shown a subterranean formation 10 in which is located a target coal seam 12. A first, substantially straight and vertical, well bore 14 has been drilled from the surface to intersect and penetrate the coal seam 12 and is lined, throughout most of its vertical length, with suitable well casing 16, 18. The well casing preferably terminates at or above the level of coal seam 12. Near the bottom of vertical well bore 14 there has been formed an enlarged diameter cavity 20. The well bore and cavity are not to scale as shown in FIGS. 1–3. The enlarged diameter cavity 20 preferably has a radius of approximately 8 feet and a vertical dimension which equals or exceeds the vertical dimension of coal seam 12. The enlarged diameter cavity is formed by using suitable prior art under-reaming techniques and equipment well known to those skilled in the art. A vertical portion of the drilled well 14 may continue below the enlarged diameter cavity 20.

Spaced a suitable distance from the first well bore 14 there is provided a second, or offset, well bore 24 which includes an upper substantially vertical portion 26, a lower substantially horizontal portion 28 and a curved or radiused portion 30 interconnecting the vertical and horizontal portions of the well bore. This well bore preferably is drilled using a combination of drilling techniques and apparatus, well known to those skilled in the art, including, for the curved and horizontal portions, an articulated drill string 32 and a suitable downhole motor and bit, illustrated schematically at 34. A prior art measurement while drilling ("MWD") device 35 is included in the drill string for controlling the orientation and direction of the well bore drilled by the motor and bit 34, in a manner well known to those skilled in the art. The substantially vertical portion of the second well bore 24 may be lined with casing, as indicated at 36, 38.

The horizontal portion 28 of offset well bore 24 preferably lies substantially in the horizontal plane of target coal seam 12 and intersects the large diameter cavity 20 provided at the bottom of well bore 14. Once the enlarged diameter cavity has been successfully intersected, the articulated drill may be used to drill a second substantially horizontal well bore 40 exiting from the enlarged diameter cavity 20 and lying substantially in the target coal seam 12.

In order to fully and uniformly drain the desired area of the target coal seam, drainage well bore 40 preferably is provided with a plurality of secondary drainage bores 42 (FIG. 3). Each of the secondary drainage bores 42 comprises a radiused curving portion coming off of the main drain bore 40 and an elongated substantially straight portion formed after the curved portion has reached the desired orientation. The methods and apparatus for forming such a bore pattern are well known to those skilled in the art of horizontal drilling. Suitable prior art devices, such as a gamma ray logging device, may be associated with the MWD mechanism 35 for controlling the direction and orientation of the drill bit and drill motor, so as to assure that the main drain bore 40 and auxiliary drainage bores 42 remain substantially in the target coal seam strata. As used herein, "substantially horizontal" with respect to the coal seam and the well bores shall be understood to include sloped, undulating or other inclinations of the coal seam.

The drainage pattern provided by the central drainage well bore 40 and auxiliary drainage well bores 42 as shown in FIG. 3 approximates the pattern of veins in a leaf or the design of a feather in that it has similar, substantially parallel, auxiliary drainage bores arranged in substantially equal and parallel spacing on opposite sides of an axis. Such a pattern is referred to as "pinnate." It has been discovered that a pinnate drainage pattern comprising a central bore with generally symmetrically arranged and appropriately spaced auxiliary drainage bores on each side provides an ideal pattern for draining fluids from a coal seam, where there is sufficient horizontal area for development of such a pattern.

A pinnate horizontal drainage pattern using a single central bore may drain a coal seam area of approximately 100 to 120 acres and is best suited for areas with relatively equal length to width ratios. Where a smaller area is to be drained, or where the coal seam has a different shape, such as a long, narrow shape, alternate drainage patterns can be developed. For example, as shown in FIG. 3, main well 114 and offset well 124 have been used to develop a drainage pattern comprising a main drain bore 140 and auxiliary drainage bores 142 arranged roughly in the shape of the letter "F". Other drainage patterns, such as one-half of a pinnate pattern, "pitchfork" patterns, etc., will be apparent tho those skilled in the art, based upon the configuration, thickness, area, etc. of the coal seam being drained.

During the process of drilling the drainage pattern, drilling fluid or "mud" must be pumped down the drill string and circulated out of the string in the vicinity of the bit, where it is used to scour the formation and to remove formation cuttings. The cuttings are then entrained in the drilling fluid which circulates up through the annulus between the drill string and the well bore walls until it reaches the surface, where the cuttings are removed from the drilling fluid and the fluid is then recirculated. This conventional drilling operation produces a standing column of drilling fluid having a vertical height equal to the depth of the well bore and produces a hydrostatic pressure on the well bore corresponding to the well bore depth. Coal seams tend to be sufficiently porous and fractured that they often are unable to sustain such a hydrostatic pressure, even when formation water also is present in the coal seam. Accordingly, if the full hydrostatic pressure is allowed to act on the coal seam, the result may be loss of drilling fluid and entrained cuttings into the formation. Such a circumstance is referred to as an "under balanced" drilling condition in which the hydrostatic fluid pressure in the well bore exceeds the ability of the formation to withstand the pressure. Loss of drilling fluid and cuttings into the formation not only is expensive in terms of lost drilling fluid, which must be made up, but it tends to plug the tiny cracks and crevices in the formation, which are needed to drain the coal seam of gas and water. Accordingly, it is important to prevent such under balanced drilling conditions.

In accordance with the present invention, under balanced drilling conditions in the drainage bores 40, 42 are avoided by circulating compressed air down the bore of vertical well 14 and back up through the offset well 24. The circulated air will admix with the drilling fluid in the annulus around the drill string 32 and create bubbles throughout the column of drilling fluid. This has the effect of lightening the hydrostatic pressure of the drilling fluid and reducing the downhole pressure sufficiently that drilling conditions do not become under balanced. Compressed air also may be circulated down through the drill string along with the drilling mud in order to aerate the drilling fluid in the annulus as the offset well is being drilled and, if desired, as the drainage pattern is being drilled. Drilling the well bore with the use of an air hammer bit or an air powered downhole motor concomitantly will supply compressed air to the drilling fluid. Compressed air which is used to power the bit or a downhole motor automatically mixes with the drilling fluid as it exits in the vicinity of the drill bit. However, the larger volume of air which can be circulated down the vertical shaft 14 permits greater aeration of the drilling fluid than generally is possible by air supplied through the drill string.

Once the main and offset wells and the desired drainage pattern have been drilled, the articulated drill string is removed from the well and the offset well capped, as indicated at 43, FIG. 2. A downhole pump, indicated diagramtically at 44, is installed in the vertical well 14 at or below the level of the target coal seam. The pump 44 is connected to the surface via a tubing string 46 and may be powered by sucker rods 47 extending down through the bore of the tubing. The sucker rods are reciprocated by a suitable surface mounted apparatus, such as the powered walking beam 48 to operate the pump. The pump is used to remove water and entrained coal fines from the coal seam via the drainage pattern. The water, once removed to the surface, as indicated at 49, may be treated for separation of methane which may be dissolved in the water and for removal of entrained fines. Once sufficient water has been removed from the coal seam, pure coal seam gas may be allowed to flow to the surface through the annulus of vertical well 14 around the tubing string 46 and removed via piping attached to the wellhead apparatus. The methane once received at the surface may be treated, compressed and pumped through a pipeline for use as a fuel in the conventional manner. If the formation is continuing to produce water, both water pumping and methane production may proceed simultaneously. Where formation gas pressure is sufficient, conventional gas lift methods and apparatus may be used to lift formation water to the surface.

In carrying out the drilling operation in accordance with the present invention, the site for the main vertical well is selected and the well is drilled to a depth sufficient to intercept the target coal seam or seams. The well preferably is logged either during or after drilling in order to locate the exact vertical depth of the target coal seam or seams. Suitable under-reaming apparatus is used to provide the enlarged diameter cavity 20 intersecting the target coal seam.

The location for the offset well 24 is selected at a sufficient distance from the vertical well 14 to permit the large radius curved section 30 and any desired horizontal section 28 to be drilled before intersecting the cavity. Since the curved portion 30 may have a radius of 100 to 150 feet or more, generally an offset distance of at least about 300 feet between the two well shafts is desirable. The offset well also is sited with a view to the desired drainage pattern to be drilled, since the horizontal portion 28 and main drainage bore 40 may be substantially aligned.

The vertical portion 26 of the offset well bore can be drilled using conventional drilling techniques, with the curved portion 30 and horizontal portion 28 being drilled using articulated or horizontal drilling techniques and equipment. If under balanced drilling conditions are of concern, drilling operations, once they reach the vicinity of the coal seams, preferably should include aeration of the drilling fluid column so as to lighten the hydrostatic pressure on the well bore. This may be accomplished by drilling using an air hammer bit or air powered drill motor or by otherwise supplying air with the drilling fluid. Once the offset well has intersected the cavity 20, additional or alternative air for lightening the hydrostatic head of the drilling fluid may be supplied down through vertical well 14 for circulation back up through the bore of offset well 24. Drilling is continued through cavity 20 using an articulated drill string and appropriate horizontal drilling apparatus to provide the main drainage bore 40 and desired auxiliary drainage bores 42 in the target coal seam. During this operation, gamma ray logging tools and conventional measurement while drilling ("MWD") technologies may be employed to control and direct orientation of the drill bit so as to retain the drainage pattern within the confines of the coal seam.

Once the drilling operation is completed, the drill string is removed from the offset well and the offset well may be capped. A downhole pump is installed in the vertical well bore for draining water from the well formation, if needed. Methane or other coal seam gas may be produced from the coal seam through the drainage pattern and recovered through the main or offset wells, or both.

One advantageous use for the method in accordance with the present invention is as a pre-mining step for removing water and methane, carbon monoxide or other dangerous gases from a coal seam in advance of subterranean mining operations for removal of the coal. Once a mine plan is adopted, it will be apparent which portions of the buried coal seams will be mined in which sequence. Main and offset wells and drainage patterns then can be drilled in the target coal seams sufficiently early to drain excess water and remove dangerous gases from the coal seam prior to mining operations reaching the affected area. This will improve both safety and efficiency of subterranean coal mining, since it will obviate the age-old problems of methane gas and water incursion into the mine area from the coal face. Additionally, the heating value of methane recovered from the coal seams before mining can be used to offset the cost of pre-mining for removal of methane and water.

The foregoing disclosure and description of the invention are illustrative only, and various changes may be made in the size, shape, materials of construction and in other details, within the scope of the appended claims, without departing from the spirit of the invention.

What is claimed is:

1. A method for producing gas from a subterranean coal seam, said method comprising:

drilling a first, substantially vertical, well bore intersecting said coal seam;

forming an enlarged diameter cavity in said first well bore at the depth of said coal seam;

drilling a second well bore offset horizontally from said first well bore, said second well bore including a substantially horizontal portion intersecting said cavity; and drilling a substantially horizontal main drainage well bore exiting said cavity and disposed in said coal seam, whereby, said gas may be produced from said coal seam through said drainage well bore.

2. The method according to claim 1 comprising additionally the step of producing gas from said coal seam.

3. The method according to claim 2 wherein said coal seam contains excess water and comprising additionally the steps of installing a pump in said cavity, draining said water from said coal seam through said drainage well bore, and pumping said water up through the bore of said first well.

4. The method according to claim 1 comprising additionally drilling a plurality of secondary drainage well bores in said coal seam, said drainage bores intersecting said main drainage well bore.

5. The method according to claim 4 wherein said main and auxiliary drainage well bores form a pinnate pattern.

6. A method of producing gas from a subterranean coal seam, said method comprising:

drilling a first, substantially straight, well bore from the surface to intersect said coal seam;

logging said first well bore to identify the depth of said coal seam;

forming an enlarged diameter cavity in said first well bore at substantially the depth of said coal seam;

drilling an offset well bore from the surface to intersect said cavity;

utilizing said offset well bore to drill a substantially horizontal main drainage well bore in said coal seam;

forming a plurality of secondary drainage bores in said coal seam, each of said secondary drainage well bores intersecting said main drainage well bore;

draining water from said coal seam through said secondary and main drainage well bores into said cavity;

pumping said water from said cavity to the surface through said first well bore;

flowing gas from said coal seam through said secondary and main drainage well bores; and conducting said gas to the surface through said first well bore.

7. The method according to claim 6 wherein said main and secondary drainage well bores form a pinnate pattern.

8. A method for providing drainage well bores in a subterranean coal seam, said method comprising:

providing a first, substantially straight well bore extending from the surface to at least the depth of said coal seam;

logging said first well bore to identify the depth where said coal seam intersects said first well bore;

enlarging the diameter of said first well bore at substantially the depth of said coal seam to provide a cavity at substantially the depth of said coal seam and in communication with said first well bore;

drilling an offset well bore spaced horizontally from said first well bore, said offset well bore including a substantially vertical portion extending from the surface to a depth less than the depth of said coal seam, a substantially horizontal portion intersecting said cavity, and a curved portion connecting said vertical and horizontal portions;

utilizing an articulated drill string extending through said offset well bore and said cavity to drill a main drainage well bore into said coal seam;

supplying drilling fluid down through said articulated drill string and back up through the annulus between said offset well bore and said articulated drill string to remove cuttings from said main drainage well bore; and admixing compressed air with said drilling fluid to reduce the hydrostatic pressure in said main drainage bore to thereby decrease the possibility of over balanced drilling conditions in said drainage bore.

9. The method according to claim 8 wherein at least a portion of said compressed air is supplied through said articulated drill string.

10. The method according to claim 8 wherein at least a portion of said compressed air is supplied through said first well bore.

11. The method according to claim 8 comprising additionally the steps of removing said articulated drill string from said drainage well bore and said offset well bore;

capping said offset well bore;

draining water and flowing gas from said coal seam through said drainage well bore;

conducting said water to the surface through said main well bore; and conducting said methane gas to the surface through said main well bore.

12. In a process for mining coal in a subterranean coal seam the improvement comprising:

pre-mining said coal seam to remove excess water and dangerous gases therefrom in advance of mining said coal in said coal seam, said pre-mining comprising, providing a substantially straight well bore communicating between the surface and said coal seam;

providing an enlarged diameter cavity in said well bore at approximately the depth of said coal seam;

drilling an offset well bore spaced horizontally from said substantially straight well bore;

drilling a substantially horizontal drainage bore from said offset well bore into said coal seam, said drainage bore communicating with said cavity;

draining said excess water and flowing said dangerous gases from said coal seam through said drainage bore and into said cavity;

conducting said water and dangerous gases from said cavity to the surface through said substantially straight well bore; and continuing said steps of draining water and flowing gas from said coal seam and to said cavity and of conducting said water and gas to the surface until the desired amounts of water and gas have been removed from said coal seam.

13. The method according to claim 12 comprising additionally providing a plurality of secondary drainage well bores in said coal seam in communication with said substantially horizontal drainage bore.

14. The method according to claim 13 wherein said substantially horizontal drainage bore and secondary drainage well bores form a pinnate pattern.

* * * * *